US008474064B2

(12) United States Patent
Hardy, III

(10) Patent No.: US 8,474,064 B2
(45) Date of Patent: Jul. 2, 2013

(54) EAR HOLE COVER FOR HEADGEAR

(76) Inventor: Sam Neverson Hardy, III, Raleigh, NC (US)

( * ) Notice: Subject to any disclaimer, the term of this patent is extended or adjusted under 35 U.S.C. 154(b) by 91 days.

(21) Appl. No.: 13/087,405

(22) Filed: Apr. 15, 2011

(65) Prior Publication Data

US 2012/0260403 A1 Oct. 18, 2012

(51) Int. Cl.
*A42B 1/06* (2006.01)

(52) U.S. Cl.
USPC ..... 2/209; 2/244; 2/423; 2/10

(58) Field of Classification Search
USPC .... 2/244, 423, 10, 209; 215/200, 296; 53/264
See application file for complete search history.

(56) References Cited

U.S. PATENT DOCUMENTS

| | | | | |
|---|---|---|---|---|
| 3,454,962 | A | 7/1969 | Hind | |
| 3,500,475 | A | 3/1970 | Otsuka | |
| 3,778,844 | A | 12/1973 | Hori et al. | |
| 4,633,532 | A | 1/1987 | Yagasaki | |
| 5,477,565 | A * | 12/1995 | Hunt, Jr. | 2/423 |
| 5,567,896 | A | 10/1996 | Gottschall | |
| 5,632,047 | A | 5/1997 | Van Den Heuvel | |
| 5,881,389 | A * | 3/1999 | Fruge | 2/202 |
| 5,924,139 | A | 7/1999 | Van Den Heuvel | |
| 6,128,786 | A * | 10/2000 | Maddux et al. | 2/418 |
| 6,499,147 | B2 * | 12/2002 | Schiebl et al. | 2/425 |
| 6,718,559 | B1 | 4/2004 | Davidson | |
| 6,874,169 | B2 | 4/2005 | Broersma | |
| 7,536,731 | B1 | 5/2009 | Feldman | |
| D625,052 | S | 10/2010 | Mastoras et al. | |
| 2004/0250337 | A1 | 12/2004 | Pietrzykowski | |
| 2006/0117463 | A1 | 6/2006 | Spinelli | |
| 2009/0049586 | A1 | 2/2009 | Wirthenstaetter | |
| 2009/0144885 | A1 | 6/2009 | Mix | |
| 2010/0299979 | A1 | 12/2010 | LaMere | |
| 2011/0225706 | A1 * | 9/2011 | Pye | 2/411 |

FOREIGN PATENT DOCUMENTS

| | | |
|---|---|---|
| GB | 2 446 627 | 8/2008 |

* cited by examiner

*Primary Examiner* — Alissa Tompkins
(74) *Attorney, Agent, or Firm* — Scott P. Zimmerman, PLLC

(57) ABSTRACT

An ear hole cover secures to an ear hole in headgear, such as baseball and football helmets. The ear hole cover has a body having an inner surface and a planar outer surface. Means are included for securing the body to the ear hole in the headgear. At least one hole extends through the body from the outer surface to the inner surface, the at least one hole for passing sound through the body to an ear of a wearer of the headgear. An indicia surface extends across the planar outer surface for displaying an indicia, such as a team logo or mascot.

21 Claims, 13 Drawing Sheets

EAR HOLE COVER FOR HEADGEAR

COPYRIGHT NOTIFICATION

A portion of the disclosure of this patent document and its attachments contain material which is subject to copyright protection. The copyright owner has no objection to the reproduction by anyone of the patent document or the patent disclosure, as it appears in the United States Patent and Trademark Office patent files or records, but otherwise reserves all copyrights whatsoever.

BACKGROUND

Exemplary embodiments generally relate to apparel and to card, picture, or sign exhibiting and, more particularly, to headgear, to guards and protectors, to insignia, to hat-carried indicia, and to circular holders.

Protective head gear (such as a helmet) has long been used in sports. A conventional helmet protects the head from injury. Helmets, though, are also marketing opportunities. Helmets are painted in team colors, and some teams even adorn their helmets with logos, adhesive stickers, and other advertising. Still, though, additional marketing opportunities exist.

BRIEF DESCRIPTION OF THE SEVERAL VIEWS OF THE DRAWINGS

The features, aspects, and advantages of the exemplary embodiments are better understood when the following Detailed Description is read with reference to the accompanying drawings, wherein.

DETAILED DESCRIPTION

The exemplary embodiments will now be described more fully hereinafter with reference to the accompanying drawings. The exemplary embodiments may, however, be embodied in many different forms and should not be construed as limited to the embodiments set forth herein. These embodiments are provided so that this disclosure will be thorough and complete and will fully convey the exemplary embodiments to those of ordinary skill in the art. Moreover, all statements herein reciting embodiments, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those of ordinary skill in the art that the diagrams, schematics, illustrations, and the like represent conceptual views or processes illustrating the exemplary embodiments. Those of ordinary skill in the art further understand that the exemplary ear guards described herein are for illustrative purposes and, thus, are not intended to be limited to any particular manufacturing process and/or manufacturer.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

It will also be understood that, although the terms first, second, etc. may be used herein to describe various elements, these elements should not be limited by these terms. These terms are only used to distinguish one element from another.

Figure 1:
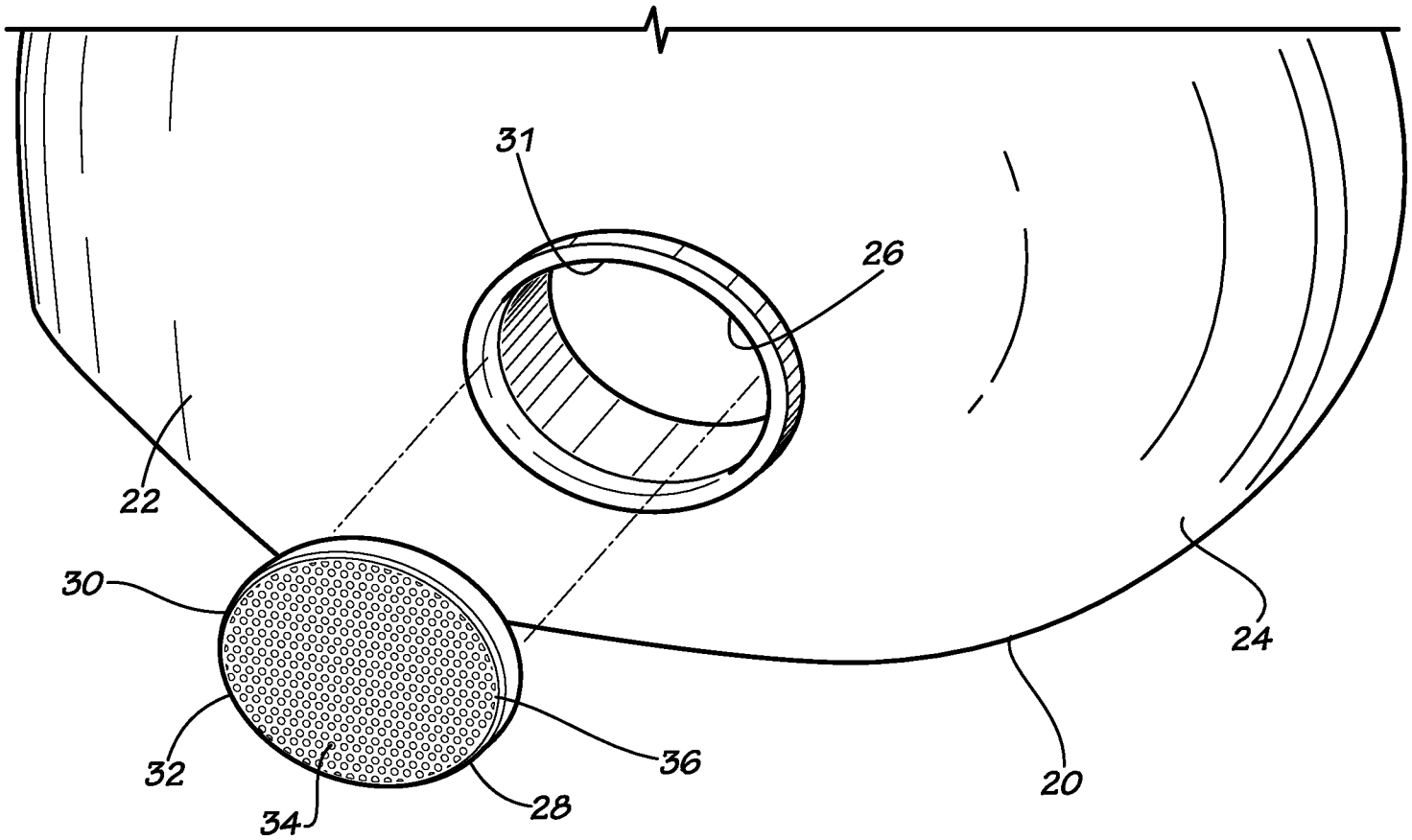
FIG. 1 is a schematic illustrating an operating environment, according to exemplary embodiments.

FIG. 1 is a schematic illustrating an operating environment, according to exemplary embodiments. FIG. 1 illustrates protective head gear 20, such as a helmet 22. The helmet 22 has an outer shell 24 and an ear hole 26. When a user or wearer dons the helmet 22, the ear hole 26 generally aligns with an ear of the wearer. The ear hole 26 thus allows sound to pass through the outer shell 24 to the ear of the wearer. The general features of the helmet 22 are well-known to those of ordinary skill in the art, so this disclosure will not provide a further explanation of the helmet 22, and other protective head gear 20, having the ear hole 26.

FIG. 1 also illustrates an ear hole cover 28, according to exemplary embodiments. The ear hole cover 28 secures to the ear hole 26 of the protective head gear 20. The ear hole cover 28, for example, has a main body 30 that inserts into the ear hole 26, and the main body 30 includes means for securing the body 30 in or to an edge 31 of the ear hole 26 (as later paragraphs will explain). The ear hole cover 28 has an outer surface 32 that reduces entry of dirt into the ear, but the outer surface 32 also includes at least one hole 34. The at least one hole 34 passes sound through the ear hole cover 28, thus still guiding the sound to the ear. The outer surface 32, however, includes an indicia surface 36 thereon. The indicia surface 36 displays a trademark, logo, saying, phrase, or any other indication. The indicia surface 36, for example, may have team logo, mascot, or jersey number printed thereon. So, as the protective head gear 20 is worn, the ear hole cover 28 may be utilized as an additional marketing opportunity to display a team logo, mascot, jersey number, or advertising imprinted thereon. The indicia surface 36 is preferably immovable in relation to the body 30 and to the outer surface 32, so an orientation of the trademark or logo (imprinted on the indicia surface 36) does not change with helmet orientation and/or activity. The indicia surface 36, in other words, is fixed or stationary and preferably cannot rotate to maintain proper visibility and readability of the trademark or logo.

Figure 2:
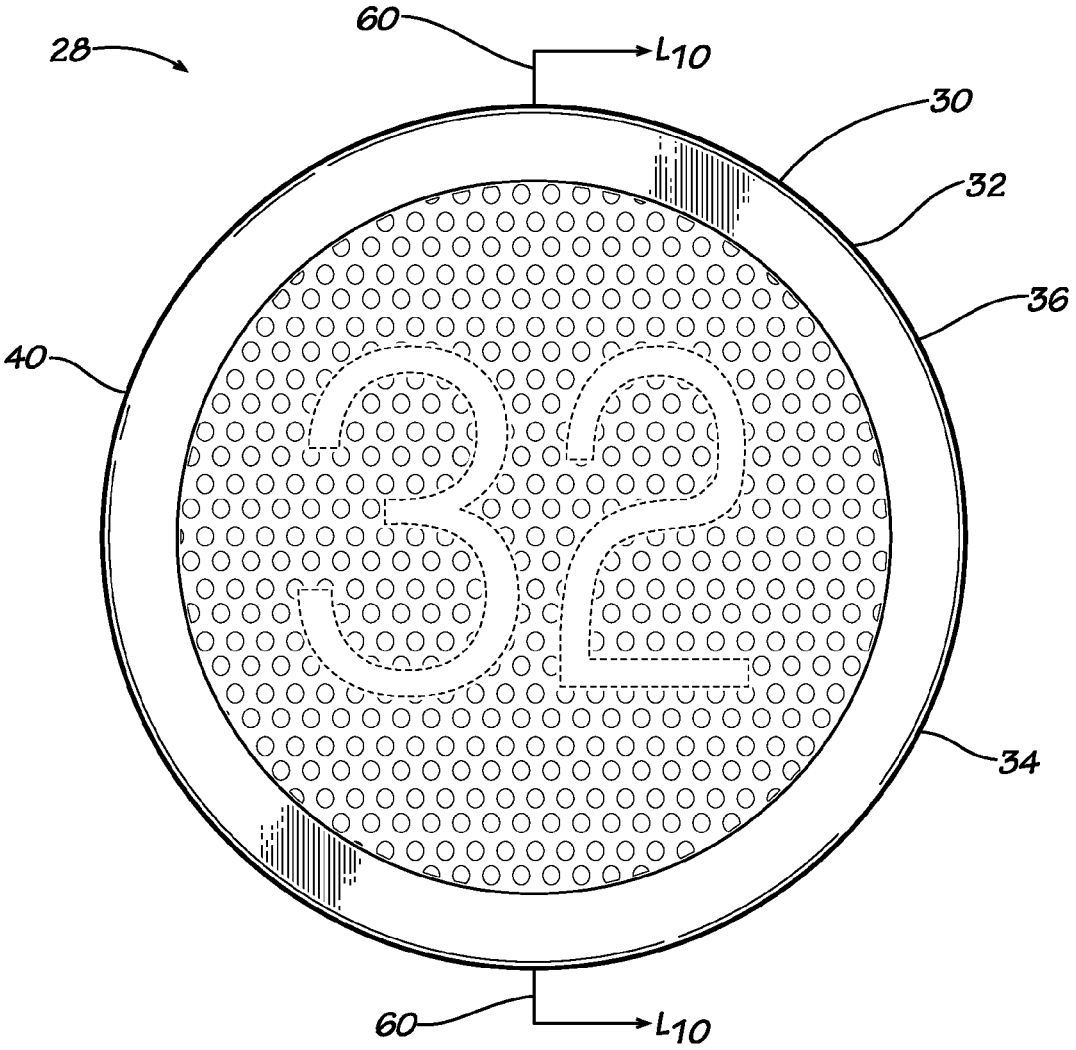
FIGS. 2-4 are schematics illustrating an ear hole cover, according to exemplary embodiments.
Figure 3:
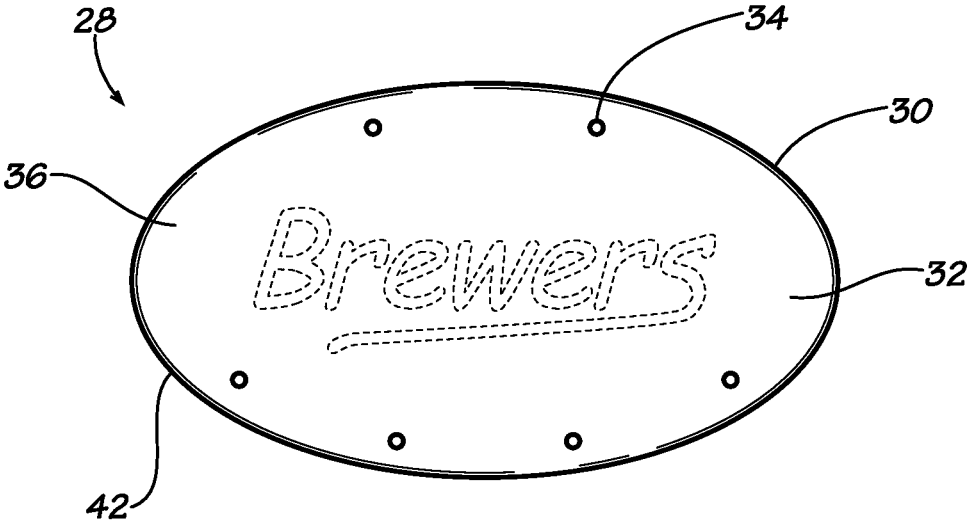
Figure 4:
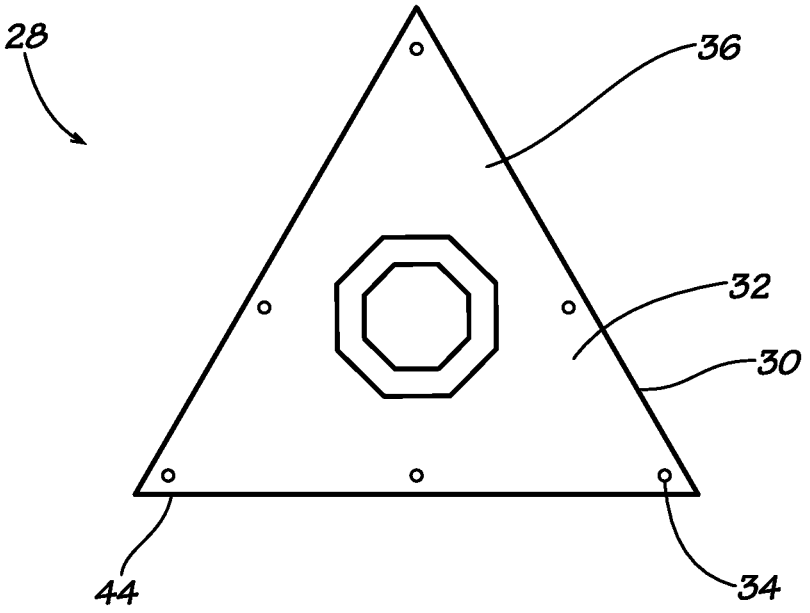

FIGS. 2-4 are schematics further illustrating the ear hole cover 28, according to exemplary embodiments. FIGS. 2-4 illustrate that the ear hole cover 28 may have any shape to suit the ear hole in the protective head gear (illustrated, respectively, as reference numerals 26 and 20 in FIG. 1). FIG. 2, for example, illustrates the body 30 of the ear hole cover 28 having a circular shape 40. The outer surface 32 and the indicia surface 36 each have the corresponding circular shape 40. The indicia surface 36 has a jersey number ("32") imprinted thereon. FIG. 3, however, illustrates the body 30, the outer surface 32, and the indicia surface 36 each having an oval shape 42. The indicia surface 36 has a team name ("Brewers") imprinted thereon. FIG. 4 illustrates the body 30, the outer surface 32, and the indicia surface 36 each having a triangular shape 44. The indicia surface 36 has a team logo (Block "O") imprinted thereon. FIGS. 2-4 thus illustrate that the ear hole cover 28 may have any shape to suit the shape of the ear hole 26 in the protective head gear 20.

Figure 5:
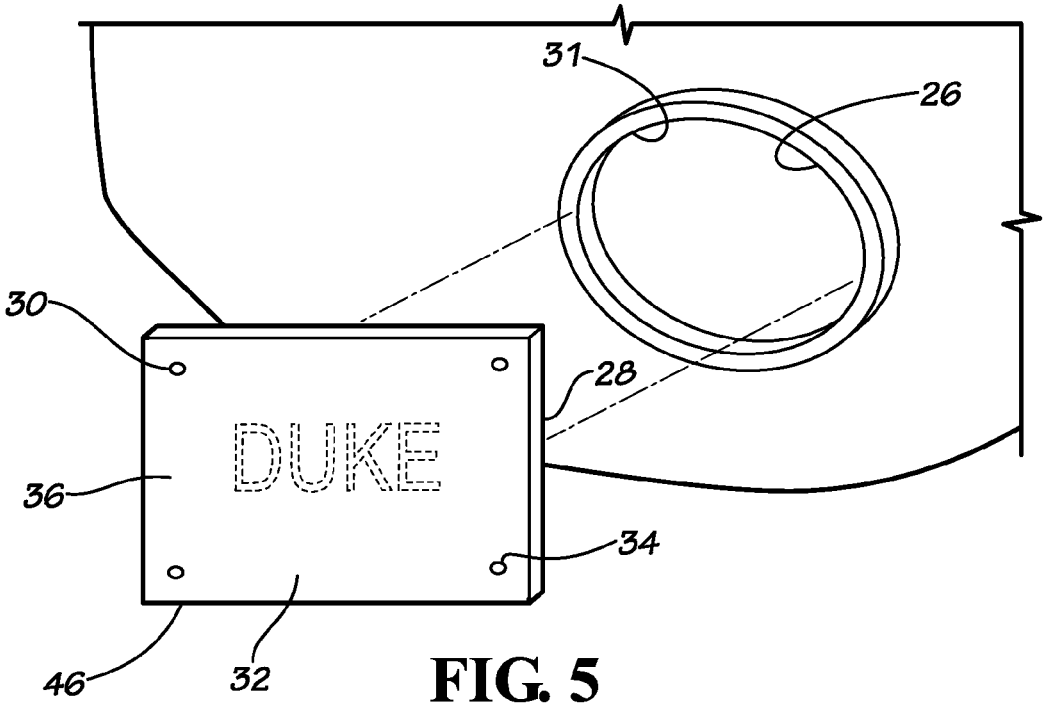
FIGS. 5-6 are schematics illustrating an outer surface of the ear hole cover, according to exemplary embodiments.
Figure 6:
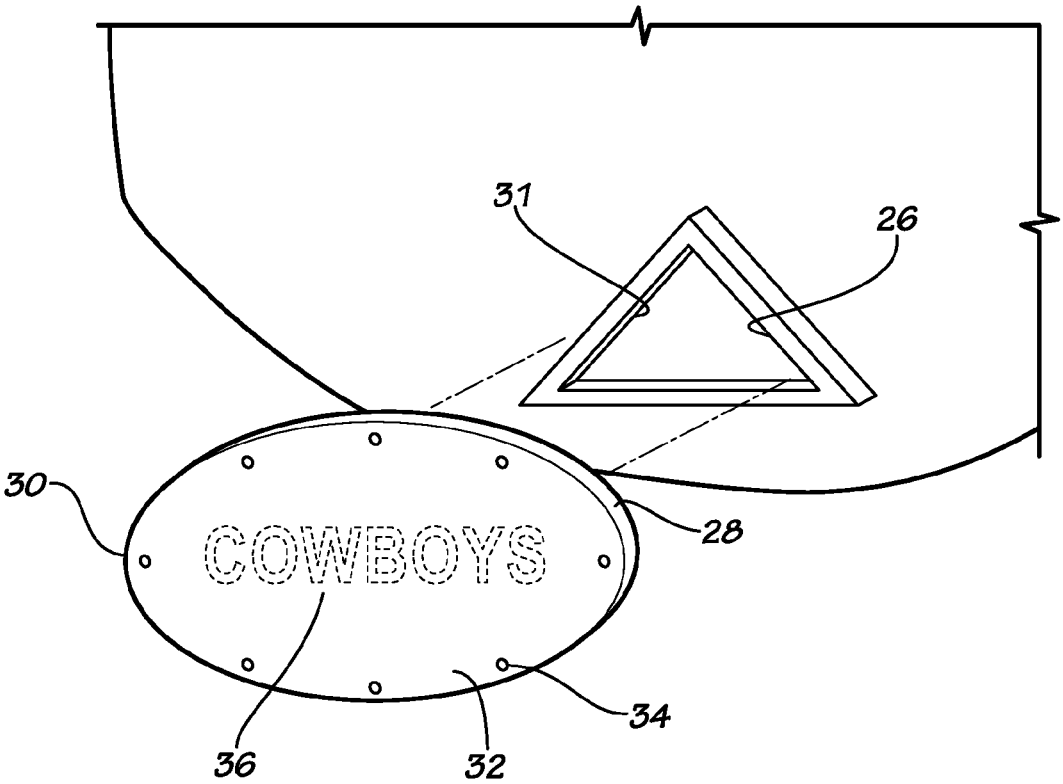

FIGS. 5-6 are schematics further illustrating the ear hole cover 28, according to exemplary embodiments. FIGS. 5-6 illustrate that the outer surface 32 of the ear hole cover 28 may have a different shape from the ear hole 26 in the protective head gear 20. FIG. 5, for example, illustrates the outer surface 32 having a polygonal shape 46 (such as a square, rectangle, or pentagon), yet the body 30 of the ear hole cover 28 may have features for securing in or to an oval-shaped ear hole 26. FIG. 6, likewise, illustrates the body 30 having an oval-shaped outer surface 32 but features for securing in or to a triangular-shaped ear hole 26. Again, then, the ear hole cover 28 may have any combination of shapes to suit the shape of the ear hole 26 in the protective head gear 20 and to suit marketing and advertising desires.

Figure 7:
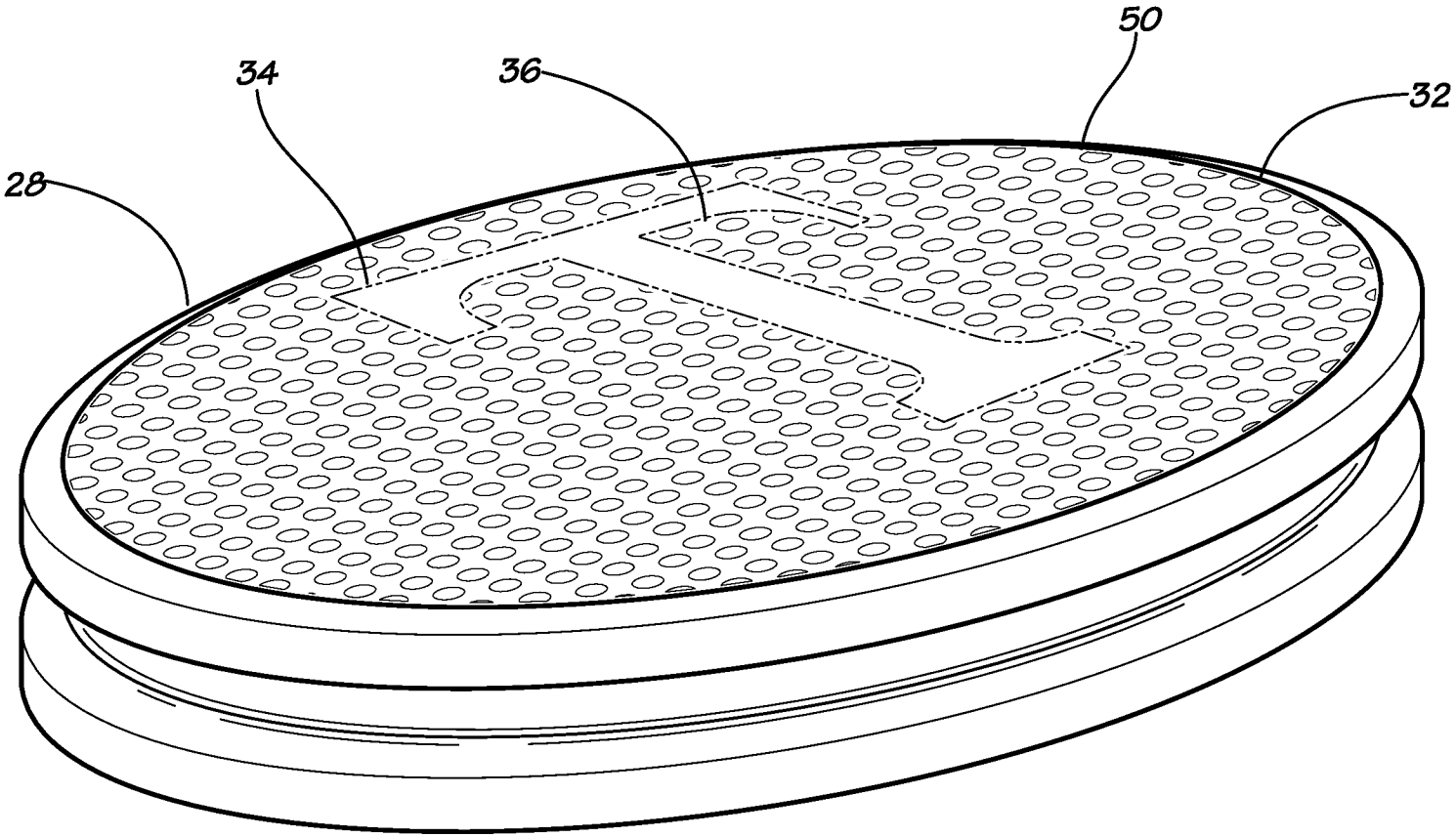
FIGS. 7-8 are schematics illustrating the outer surface and an indicia surface, according to exemplary embodiments.
Figure 8:
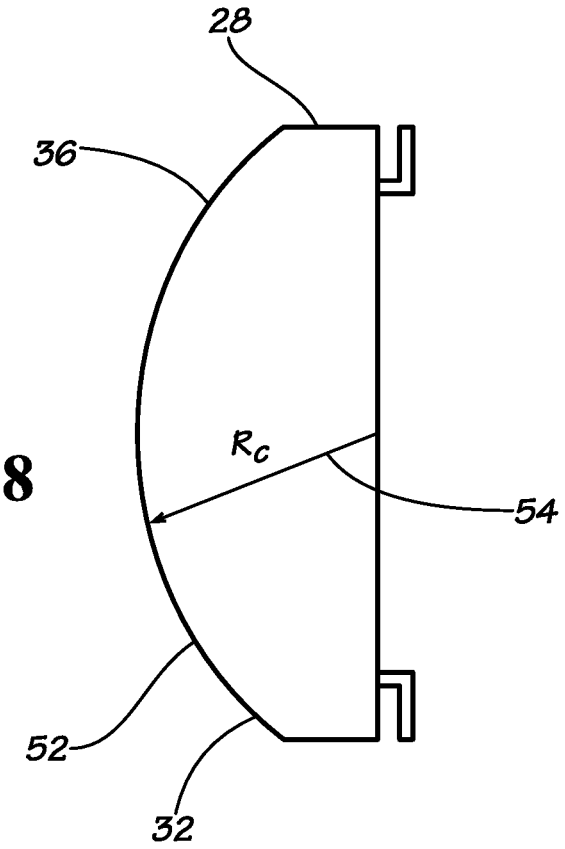

FIGS. 7-8 are schematics further illustrating the outer surface 32 and the indicia surface 36, according to exemplary embodiments. FIG. 7 illustrates that the outer surface 32 and the indicia surface 36 may be generally planar. Because the indicia surface 36 displays any trademark or logo (such as a "T" imprinted thereon), the indicia surface 36 is preferably sized and shaped to maximize visibility and clarity of the imprinted indication or indicia. The outer surface 32 and the indicia surface 36, then, preferably have a generally or nearly flat, even outer contour 50 to maximize visibility and clarity of advertising. Moreover, the generally planar indicia surface 36 preferably extends across the outer surface 32 in two dimensions (width and depth) to again maximize visibility and clarity of advertising imprinted thereon. FIG. 8, though, is a side view of the ear hole cover 28 and illustrates a convex outer profile 52. Here the outer surface 32 may have a gentle outer, cross-sectional contour that still maximizes visibility and clarity of advertising. The convex outer profile 52 may have a fixed or nearly constant radius of curvature $R_C$ (illustrated as reference numeral 54) that still maximizes visibility and clarity of advertising.

Figure 9:
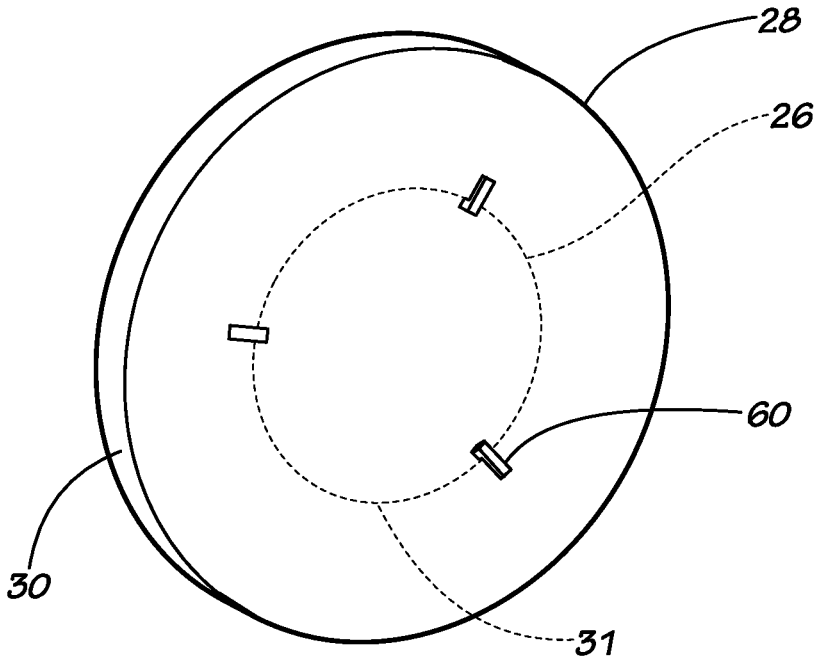
FIGS. 9-11 are schematics illustrating additional views of the ear hole cover, according to exemplary embodiments.
Figure 10:
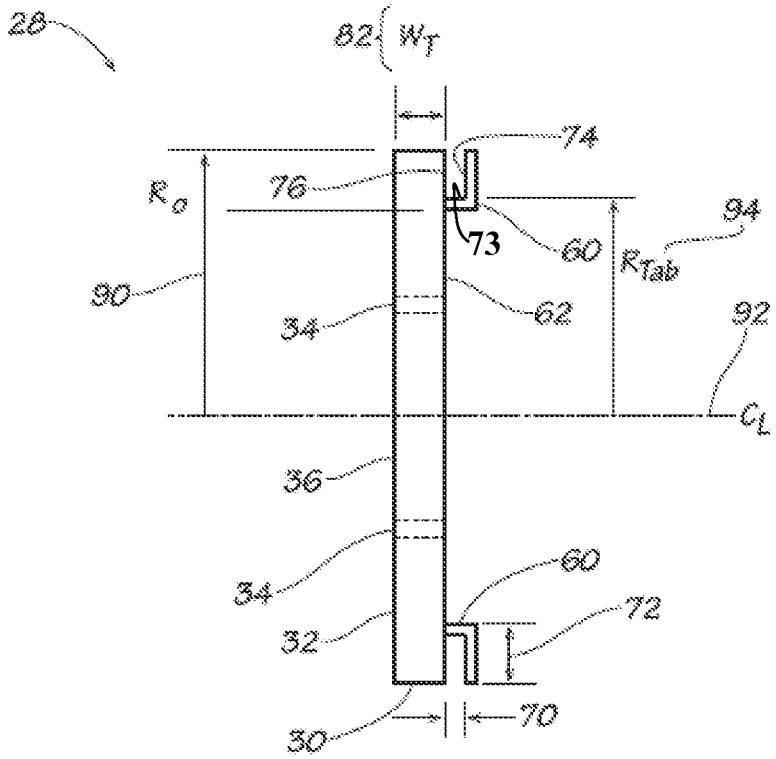

FIGS. 9-10 are schematics further illustrating the ear hole cover 28, according to exemplary embodiments. FIGS. 9 and 10 are, respectively, back and sectional side views of the ear hole cover 28 illustrated in FIG. 2. The sectional view of FIG. 10 is taken along line $L_{10}$-$L_{10}$ (illustrated as reference numeral 60) in FIG. 2. FIG. 9 illustrates means for securing the body 30 to the edge 31 of the ear hole 26. One or more tabs 60 outwardly extend from the body 30. The tabs 60 secure the body to the edge 31 of the ear hole 26, as the below paragraphs explain.

FIG. 10 illustrates a sectional view of the ear hole cover 28. The sectional view is illustrated slightly enlarged for clarity. FIG. 10 illustrates the ear hole cover 28 having the main body 30, the outer surface 32, an inner surface 62, and the tabs 60. The at least one hole 34 extends through the main body 30 from the outer surface 32 to the inner surface 62 to permit passage of sound waves. FIG. 10 only illustrates a few holes 34 for simplicity, but there may be fewer or many holes.

The main body 30 may include means for securing the body 30 to the ear hole (illustrated as reference numeral 26 in FIG. 1). FIG. 10, for example, illustrates the one or more tabs 60 that secure the body 30 to the edge (illustrated as reference numeral 31 in FIG. 1) of the ear hole 26. The tabs 60 outwardly extend from the inner surface 62 of the body 30. When the ear hole cover 28 is inserted into the ear hole 26, each tab 60 aligns to and slides over the edge 31 of the ear hole 26. Each tab 60 may be offset a gap or width 70 from the inner surface 62 to accommodate an edge thickness of the edge 31 of the ear hole 26. Each tab 60 may also have a depth 72 and a floor 73. The width 70 and the depth 72 are sized to accept and to frictionally engage the edge 31 of the ear hole 26. Each the tab 60 thus creates opposite side walls 74 and 76 that retain the body 30 in the ear hole 26. As FIG. 10 illustrates, the ear hole cover 28 may also be molded or formed of a single, unitary piece of material (as later paragraphs will explain).

The main body 30 has a material thickness $W_T$ between the outer surface 32 and the inner surface 62. The at least one hole 34 extends through the body 30 from the outer surface 32 to the inner surface 62 to permit passage of sound waves. The material thickness $W_T$ (illustrated as reference numeral 82) may impact durability and cost. If the material thickness $W_T$ is too thin, the body 30 may tear with repeated use. The material thickness $W_T$, therefore, is selected such that the ear hole cover 28 is durable enough to be repeatedly inserted into, and/or removed from, the protective headgear (illustrated as reference numeral 20 in FIG. 1). As the material thickness $W_T$ increases, though, the unit cost of the ear hole cover 28 increases. Moreover, as the material thickness $W_T$ increases, the ear hole cover 28 becomes heavier and less pliable. The material thickness $W_T$, then, is selected for acceptable durability but also for a target unit cost and for ease of use.

The material thickness $W_T$ may also affect the at least one hole 34. When the body 30 has a thin material thickness $W_T$ (illustrated as reference numeral 82), the outer surface 32 (and thus the indicia surface 36 thereon) may resemble a screen. That is, when the body 30 has a thin material thickness $W_T$, the at least one hole 34 may appear to be a perforation in the outer surface 32. Conversely, when the body 30 has a thicker material thickness $W_T$, the at least one hole 34 may appear to be a passage or channel extending from an opening in the outer surface 32 to a corresponding opening at the inner surface 62.

As FIG. 10 also illustrates, the body 30 has an outer diameter. The outer diameter has a corresponding outer radius $R_O$ (illustrated as reference numeral 90) from a centerline $C_L$ (illustrated as reference numeral 92) of the body 30. The outer radius $R_O$ may have any size to suit any design constraints. The outer radius $R_O$, for example, is preferably sized to maximize the indicia surface 36, but the outer diameter may not be so large as to intrude upon other features of the protective headgear 20 (such as a face guard).

The tabs 60 may be positioned to suit the shape of the ear hole 26. When, for example, the ear hole 26 has a circular shape, then the floor 73 of the tabs 60 may spaced about a tab diameter. The tab diameter, likewise, has a corresponding inner radius $R_{Tab}$ (illustrated as reference numeral 94) from the centerline $C_L$ of the body 30. The tabs 60 outwardly extend from the inner surface 62 of the body 30. Each tab 60 may be offset the gap or width 70 from the inner surface 62 and the depth 72 from the outer radius $R_O$. The width 70 and the depth 72 may be chosen to approximate a diameter of the edge 31 of the ear hole 26, such that the tabs 60 accept and frictionally engage the edge 31 of the ear hole 26.

Figure 11:
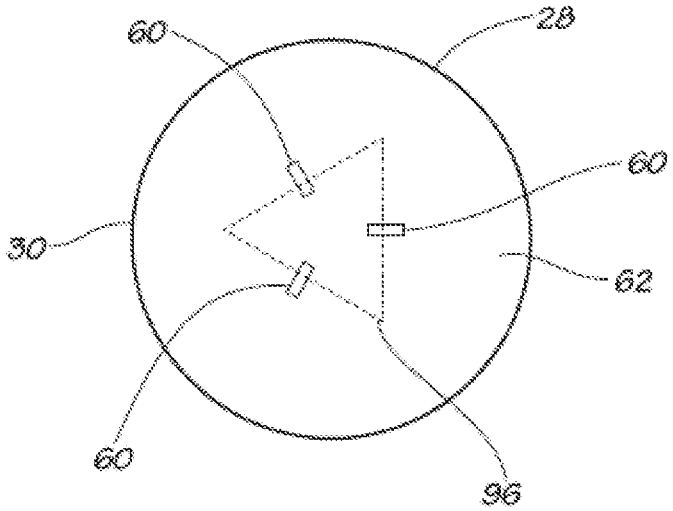

FIG. 11 is another schematic illustrating the means for securing to the ear hole 26, according to exemplary embodiments. Here the tabs 60 are arranged to secure the ear hole cover 28 to a triangularly-shaped ear hole (illustrated as reference numeral 26 in FIG. 1). FIG. 11 illustrates the inner surface 62 of the body 30 with the tabs 60 arranged along a triangular perimeter or periphery 96. The triangular perimeter 96 is sized to accept and to frictionally engage the edge 31 of the triangularly-shaped ear hole 26. The tabs 60 outwardly extend from the inner surface 62 of the body 30. Each tab 60 may again be offset the width and the depth (illustrated as reference numerals 70 and 72 in FIG. 10).

One of ordinary skill in the art should now realize that the tabs 60 may have any arrangement. Whatever the shape of the ear hole 26, the tabs 60 may be arranged to suitably secure the body 30 of the ear hole cover 28 to the edge 31 of the ear hole 26. The tabs 60, for example, may be arranged along a square perimeter to suit a squarely-shaped ear hole 26. The tabs 60 may be even be arranged to secure to an arbitrary-shaped ear hole 26, such as a lightning bolt, star, or pirate. Should the ear hole 26 have a shape to match a team logo (such as a star-shaped hole for THE DALLAS COWBOYS® or a pirate-shaped hole for THE PITTSBURGH PIRATES®), the tabs 60 may be arranged to secure the logo-shaped ear hole 26.

Figure 12:
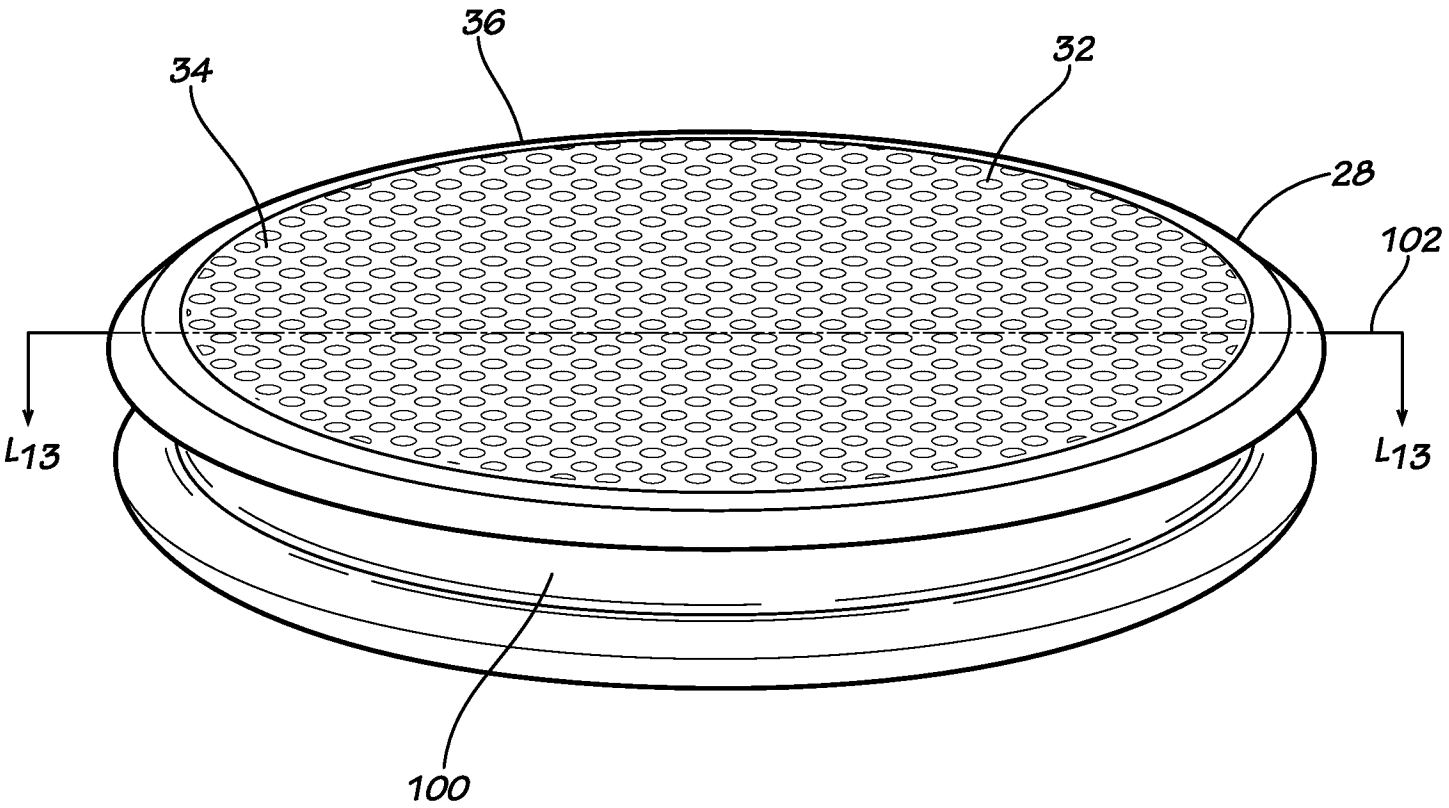
FIGS. 12-15 are more schematics illustrating means for securing to the ear hole, according to exemplary embodiments.
Figure 13:
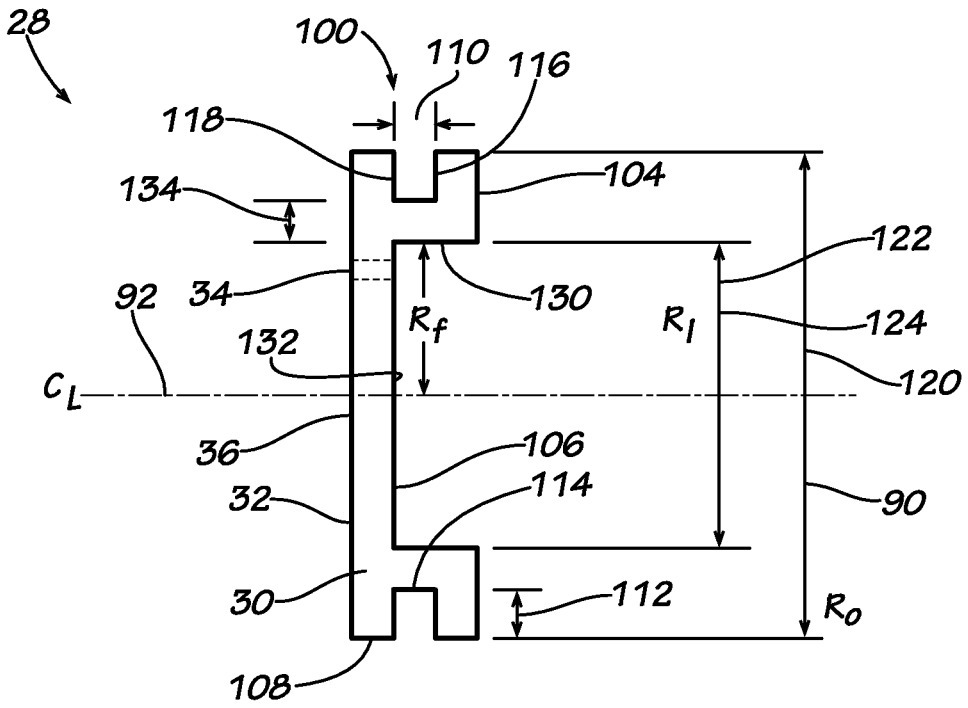
Figure 14:
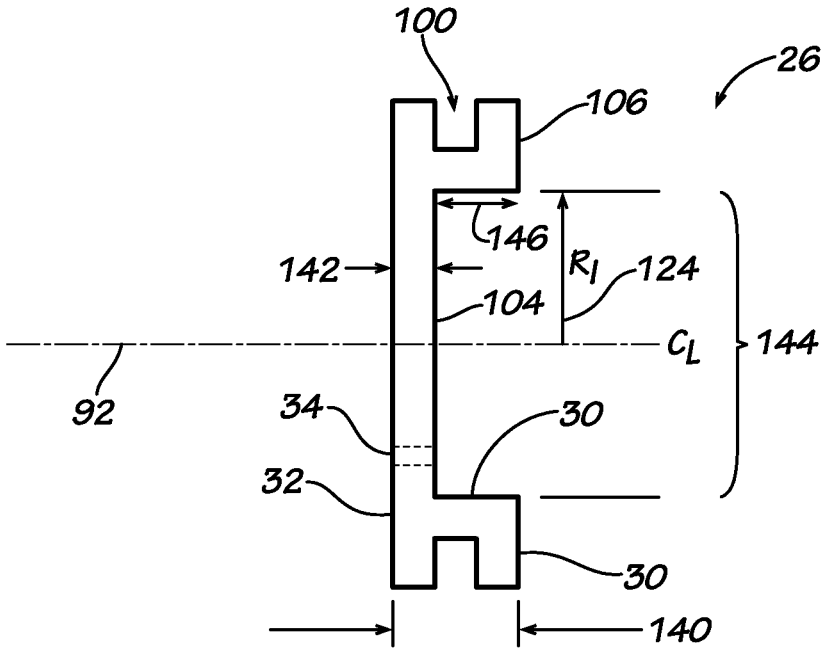

FIGS. 12-14 are more schematics illustrating the means for securing to the ear hole 26, according to exemplary embodiments. Here a peripheral channel 100 secures the ear hole cover 28 in the ear hole 26. FIG. 12 illustrates an isometric view of the ear hole cover 28, while FIGS. 13 and 14 are sectional views taken along line $L_{13}$-$L_{13}$ (illustrated as reference numeral 102) in FIG. 12. As FIG. 13 illustrates, the ear hole cover 28 has the body 30, the outer surface 32, a first inner surface 104, and a second inner surface 106. (The second inner surface 106 may be considered a backside of the outer surface 32 and the indicia surface 36.) The at least one hole 34 extends through the body 30 from the outer surface 32 to the second inner surface 106 to permit passage of sound waves. Again, only a few holes 34 are illustrated for simplicity.

The body 30 includes the peripheral channel 100. The peripheral channel 100 is formed or molded along a circumferential or peripheral edge 108 of the body 30. When the ear hole cover 28 is inserted into the ear hole 26 of the protective headgear 20, the peripheral channel 100 is aligned to, and slid or pushed onto and along, the edge 31 of the ear hole 26. The peripheral channel 100 thus has a width 110 and a depth 112 sized to accept and frictionally engage the edge 31 of the ear hole 26. The depth 112 of the peripheral channel 100 is measured from the circumferential or peripheral edge 108 of the body 30 to a floor 114 of the peripheral channel 100. The peripheral channel 100 thus has opposite side walls 116 and 118 that upwardly extend from the floor 114 of the peripheral channel 100 to retain the body 30 in the ear hole 26.

The body 30 has an outer diameter 120 and an inner diameter 122. The outer diameter 120 has the corresponding outer radius $R_O$ (illustrated as reference numeral 90) from the centerline $C_L$ (illustrated as reference numeral 92) of the body 30. The inner diameter 122, likewise, has a corresponding inner radius $R_I$ (illustrated as reference numeral 124) from the centerline $C_L$ of the body 30.

The body 30 also includes an inner circumferential surface 130. The difference in length between the outer radius $R_O$ (illustrated as reference numeral 90) and the inner radius $R_I$ (illustrated as reference numeral 124) defines a maximum value for the depth 112 of the peripheral channel 100. In production, though, the floor 114 of the peripheral channel 100 will be formed at a floor radius $R_f$ (illustrated as reference numeral 132) that is greater than the inner radius $R_I$ but less than the outer radius $R_O$. The difference between the floor radius $R_f$ and the inner radius $R_I$ defines a floor thickness 134 between the inner circumferential surface 130 and the floor 114 of the peripheral channel 100.

The floor thickness 134 impacts durability and cost. If the floor thickness 134 is too small, the floor 114 of the peripheral channel 100 may tear with repeated use. The floor thickness 134, therefore, is selected such that the ear hole cover 28 is durable enough to be repeatedly inserted into the protective headgear (illustrated as reference numeral 20 in FIG. 1). As the floor thickness 134 increases, though, the unit cost of the ear hole cover 28 increases. The floor thickness 134, then, is selected for acceptable durability but also for a target unit cost.

FIG. 14 is another partial, sectional view taken along the line $L_{13}$-$L_{13}$ (illustrated as reference numeral 102 in FIG. 12). FIG. 14 is also enlarged for clarity of additional features. FIG. 14 illustrates an outer width 140 of the body 30 and an indicia thickness 142. The indicia thickness 142 is measured from the outer surface 32 to the first inner surface 104. FIG. 14 thus illustrates the first inner surface 104 displaced from the second inner surface 106. The inside radius $R_I$ (illustrated as reference numeral 124) and the inner circumferential surface 130 thus define a central bore 144 along the centerline $C_L$ (illustrated as reference numeral 92) of the body 30. The central bore 144 extends into the body 30 from the second inner surface 106 to a depth 146 at the first inner surface 104. The depth 146 of the central bore 144 thus also defines the indicia thickness 142. The holes 34 thus extend from the outer surface 32, through the indicia thickness 142, and to the first inner surface 104 of the body 30. The holes 34, then, may be channels or passages through which sound travels to a human ear.

The indicia thickness 142 also impacts durability and cost. If the indicia thickness 142 is too thin, the indicia surface 36 may also tear with repeated use. Because the indicia surface 36 displays a logo or trademark, a torn indicia surface 36 would impair marketing efforts. The indicia thickness 142, therefore, is also selected such that the indicia surface 36 is durable enough to be repeatedly inserted into the protective headgear (illustrated as reference numeral 20 in FIG. 1). As the indicia thickness 142 increases, though, the unit cost of the ear hole cover 28 increases. The indicia thickness 142, then, is again selected for acceptable durability but also for a target unit cost.

Figure 15:
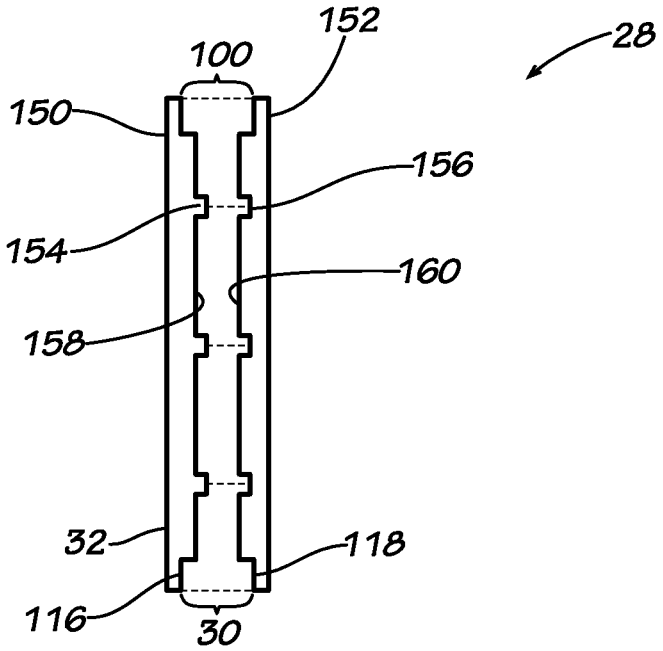

FIG. 15 is a schematic further illustrating the means for securing to the ear hole 26, according to exemplary embodiments. Here the body 30 may be split or halved along the circumferential channel 100 to form at least two mating members. A left member 150 may be placed to an outer edge of the ear hole (illustrated, respectively, as reference numeral 31 and 26 in FIG. 1), while a right member 152 is placed to an inner edge 31 of the ear hole 26. The left member 150 and the right member 152 may then be squeezed or pressed together to surround, or "sandwich," the ear hole 26. When the at least two mating members are pressed together, the peripheral channel 100 aligns along the edge 31 of the ear hole 26. The peripheral channel 100 is again sized (e.g., the width 110 and the depth 112 illustrated in FIG. 13) to frictionally secure the body 30 to the edge 31 of the ear hole 26. The opposite side walls 116 and 118 retain the body 30 in the ear hole 26, with the opposite side walls 116 and 118 respectively extending from the left member 150 and the right member 152.

FIG. 15 also illustrates means for engaging the left member 150 and the right member 152. When the body 30 is split or halved to form the at least two mating members, the left member 150 may inadvertently separate from the right member 152 A batter swinging a bat during a baseball game, for example, may generate motions and forces that could inadvertently separate the left member 150 from the right member 152. An advertiser would obviously not want their message corrupted by a malfunctioning ear hole cover 28. Exemplary embodiments, then, may include means for engaging the left member 150 to the right member 152. The means for engaging the left member 150 to the right member 152 prevents inadvertent separation during normal use. FIG. 15, for example, illustrates one or more male protrusions 154 that engage female receptacles 156. Each male protrusion 154 may outwardly extend or project from a left mating surface 158 of the left member 150, while each female receptacle 156 inwardly bores into a right mating surface 160 of the right member 152. When the left member 150 and the right member 152 are pressed together to surround, or "sandwich," the ear hole 26, each male protrusion 154 aligns with, and inserts into, its corresponding female receptacle 156. The means for engaging the left member 150 to the right member 152, however, may additionally or alternatively include mechanical fasteners (e.g., screws and/or bolts), adhesive, or hook-and-loop fastener. The means for engaging the left member 150 to the right member 152 may additionally or alternatively include features that lock or engage when the left member 150 is rotated with respect to the right member 152.

The means for securing to the ear hole 26 may comprise other features. The ear hole cover 28, for example, may include male/female snap connectors that secure the ear hole cover 28 to the ear hole 26 and/or the protective head gear 20. The means for securing to the ear hole 26 may comprise straps that secure the ear hole cover 28 to the ear hole 26 and/or the protective head gear 20. The means for securing to the ear hole 26 may comprise screws, bolts, and/or other mechanical fasteners that secure the ear hole cover 28. The means for securing to the ear hole 26 may comprise an adhesive or a hook-and-loop fastener.

Figure 16:
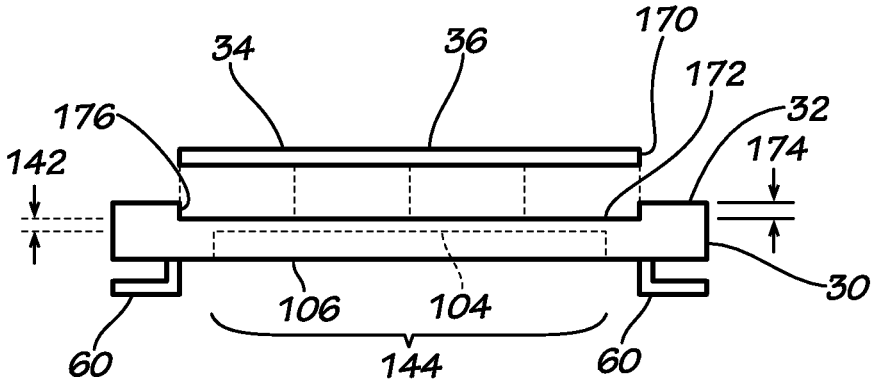
FIG. 16 is a schematic further illustrating the ear hole cover, according to exemplary embodiments.

FIG. 16 is a schematic further illustrating the ear hole cover 28, according to exemplary embodiments. Here the indicia surface 36 may be a separate component from the body 30. That is, the indicia surface 36 may be an insert 170 that is inserted into, or molded to, the body 30. The insert 170 may be a perforated disc or screen that has been, or will be, imprinted with a trademark or logo. The at least one hole 34 extends through the insert 170. The body 30 may include a recess surface 172 at a recess depth 174 from the outer surface 32. The recess surface 172 is also defined by a recess wall 176. The recess wall 176 has a shape matching an outer perimeter of the insert 170. The recess wall 176 may include an outwardly extending lip or flange (not shown) that helps retain the insert 170 in the recess. Moreover, the ear hole cover may include the central bore 144 extending into the body 30 from the second inner surface 106 to the first inner surface 104 (thus defining the indicia thickness 142). The holes 34 thus extend through the insert 170, through the indicia thickness 142, and to the first inner surface 104 of the body 30. Again, only a few holes 34 are illustrated for simplicity.

Figure 17:
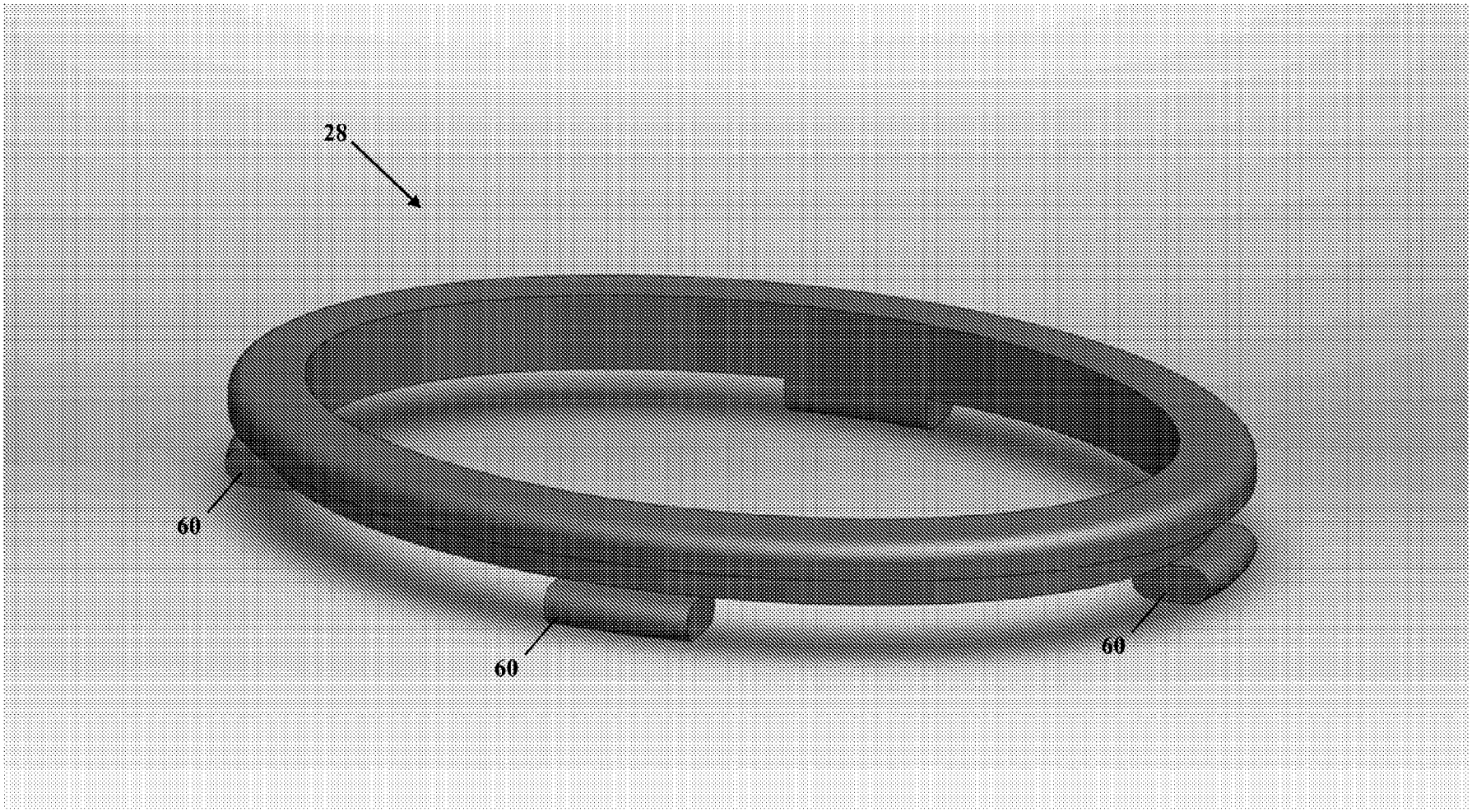
FIGS. 17-19 are more schematics further illustrating the tabs, according to exemplary embodiments.
Figure 18:
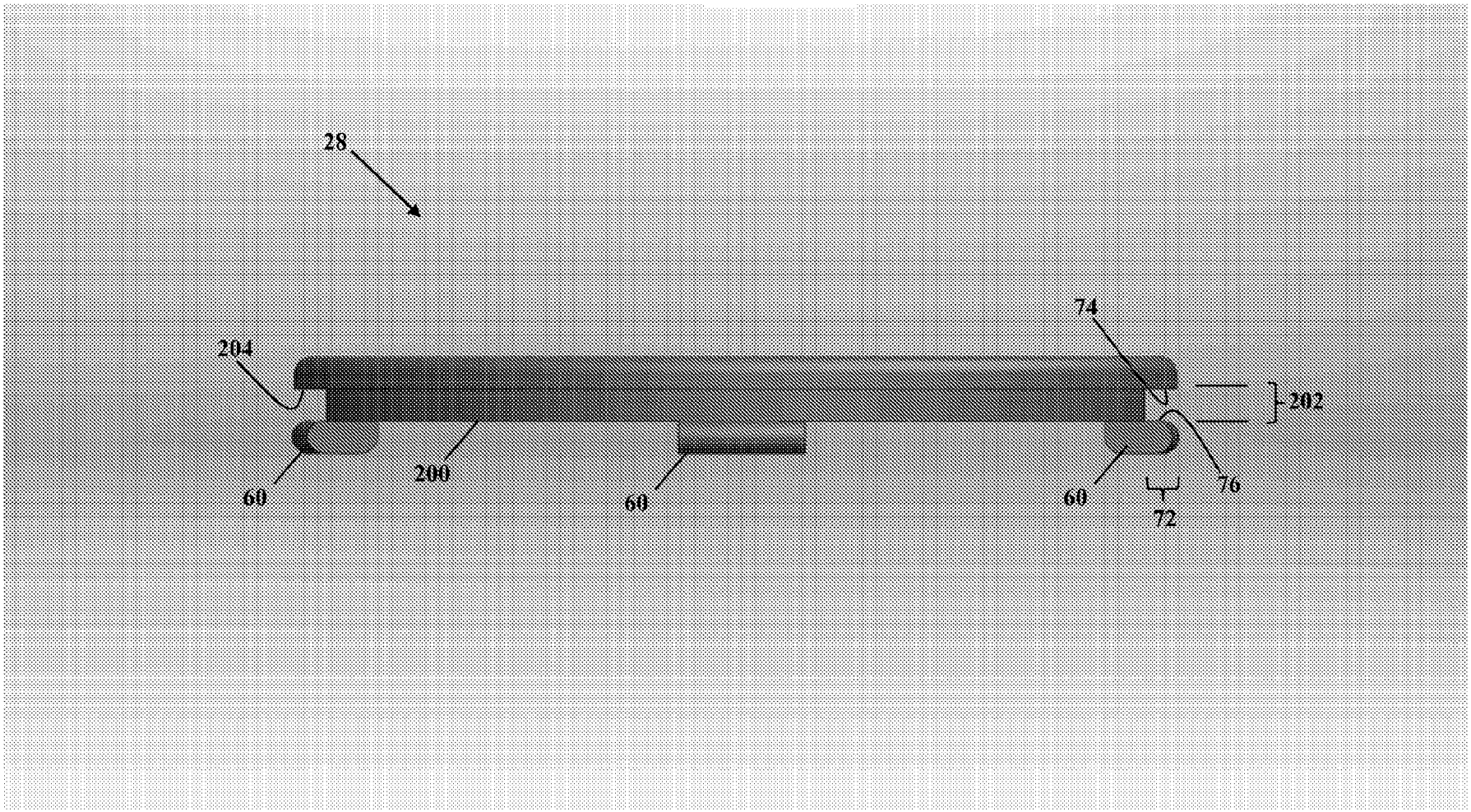
Figure 19:
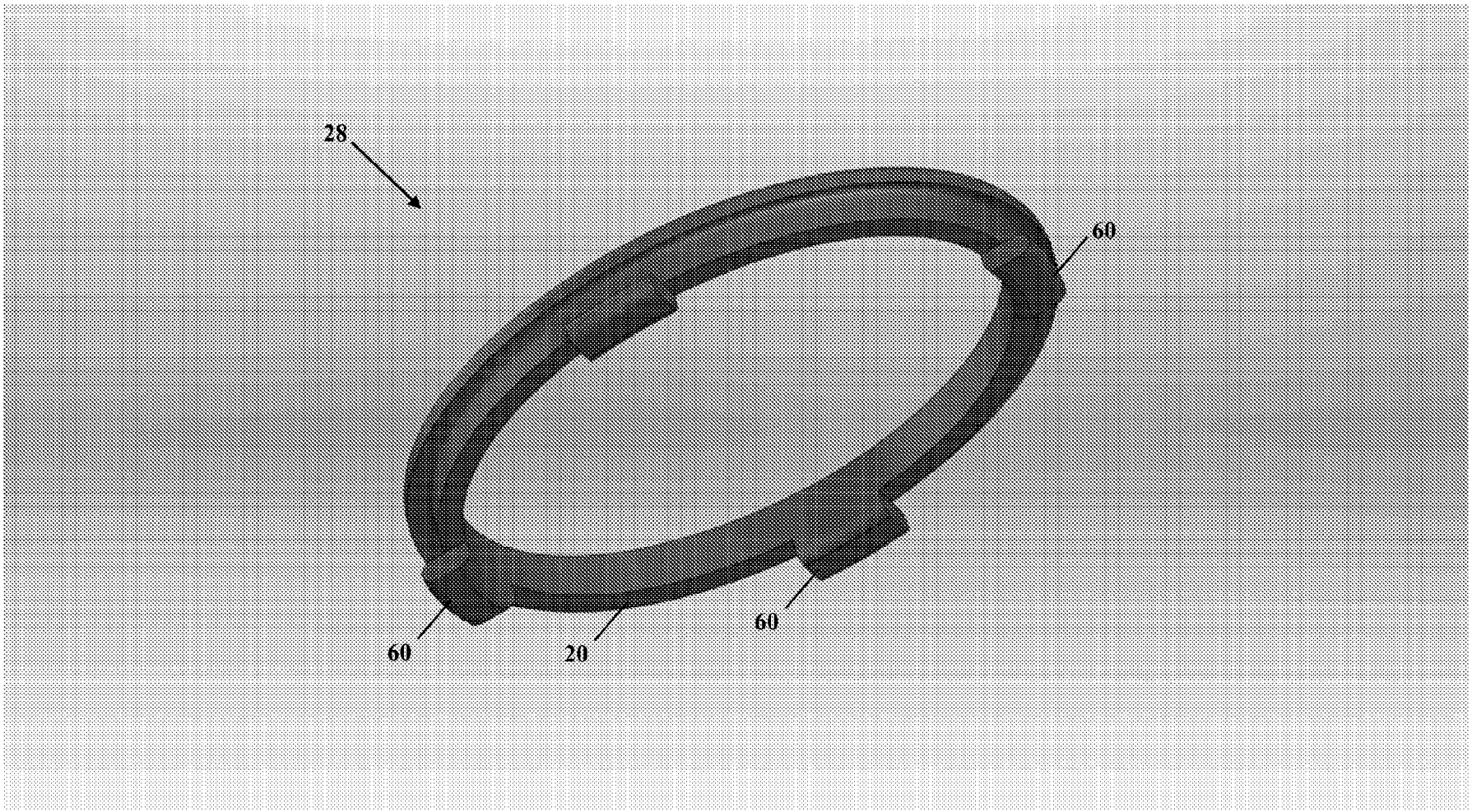

FIGS. 17-19 are more schematics further illustrating the tabs 60, according to exemplary embodiments. Here, four (4) tabs 60 are illustrated. The tabs 60 outwardly and/or upwardly extend from a first inner surface 62 of the main body 30. For simplicity and clarity, these views omit the at least one hole 34 and the indicia surface 36. When the ear hole cover 28 is inserted into the ear hole 26, each tab 60 aligns to and slides over the edge 31 of the ear hole 26. Each tab 60 may be offset a width 202 from a second inner surface 204 to accommodate an edge thickness of the edge 31 of the ear hole 26. Each tab 60 may also have the depth 72. The width 202 and the depth 72 are sized to accept and to frictionally engage the edge 31 of the ear hole 26. Each the tab 60 thus creates the opposite side walls 74 and 76 that retain the body 30 in the ear hole 26.

Exemplary embodiments of the ear hole cover 28 may be formed of any material. The ear hole cover 28 may be molded or machined from any plastic, rubber, polymer, wood, or metal material. Preferably, though, the ear hole cover 28 is fabricated from a pliable material to permit insertion and removal from the ear hole 26 in the protective head gear 20. The ear hole cover 28, for example, may be constructed from any thermoplastic and/or thermosetting polymer (such as polyethylene, polystyrene, polyvinyl chloride and polytetrafluoroethylene or PTFE). Indeed, any natural or synthetic polymer material is suitable for the ear hole cover 28. The ear hole cover 28, however, may be constructed from wood, cellulose materials, and/or metal.

While the exemplary embodiments have been described with respect to various features, aspects, and embodiments, those skilled and unskilled in the art will recognize the exemplary embodiments are not so limited. Other variations, modifications, and alternative embodiments may be made without departing from the spirit and scope of the exemplary embodiments.

What is claimed is:

1. An ear hole cover for headgear comprising;

headgear adapted to be worn on a head of wearer comprising an ear hole that is configured to generally align with an ear of the wearer, the ear hole cover comprising;

a body having an inner surface and a planar outer surface;

at least two tabs securing the body to an edge of an ear hole in the headgear, the at least two tabs outwardly extending from the inner surface, each tab offset a gap from the inner surface to accommodate the edge of the ear hole, the at least two tabs spaced about a radius that is less than an outer radius of the body, each tab defining opposite side walls that slide over the edge of the ear hole, thus securing the body to the edge of the ear hole;

at least one hole extending through the body from the outer surface to the inner surface, the at least one hole configured for passing sound through the body to an ear of a wearer of the headgear; and an indicia surface extending across the planar outer surface for displaying an indicia.

2. The ear hole cover according to claim 1, wherein the body has a circular shape.

3. The ear hole cover according to claim 1, wherein the body has an oval shape.

4. The ear hole cover according to claim 1, wherein the body has a triangular shape.

5. The ear hole cover according to claim 1, wherein the outer surface has a circular shape.

6. The ear hole cover according to claim 1, wherein the outer surface has an oval shape.

7. The ear hole cover according to claim 1, wherein the outer surface has a triangular shape.

8. The ear hole cover according to claim 1, wherein the body is a single component comprising the inner surface, the planar outer surface, the at least two tabs securing the body in the ear hole in the headgear, and the indicia surface.

9. The ear hole cover according to claim 1, wherein each tab has a depth not exceeding the outer radius of the body.

10. The ear hole cover according to claim 1, wherein the indicia surface is a separate component from the body, the indicia surface inserting into a recess surface in the body, the recessed surface defined by a wall at a depth from the outer surface.

11. The ear hole cover according to claim 1, wherein the body comprises a single component comprising the inner surface, the planar outer surface, the channel between the inner surface and the outer surface, and the indicia surface.

12. An ear hole cover for headgear comprising;

headgear adapted to be worn on a head of wearer comprising an ear hole that is configured to generally align with an ear of the wearer, the ear hole cover comprising;

a unitary body having an inner surface and a planar outer surface;

at least two tabs outwardly extending from the inner surface of the body for positioning the body to an edge of an ear hole in the headgear, the at least two tabs arranged along a shaped perimeter that matches the edge of the ear hole, each tab offset a gap from the inner surface to accommodate a thickness of the edge of the ear hole, each tab having a floor at a radius of the body, the radius of the floor less than an outer radius of the body, each tab also having a depth defining opposite side walls that slide over the edge of the ear hole, thus securing the body to the edge of the ear hole;

at least one hole extending through the body from the outer surface to the inner surface, the at least one hole configured for passing sound through the body to an ear of a wearer of the headgear; and a generally even indicia surface extending across the outer surface for displaying an indicia.

13. The ear hole cover according to claim 12, wherein the at least two tabs are spaced apart along the inner surface of the body.

14. The ear hole cover according to claim 12, wherein the shaped perimeter is a circle such that the at least two tabs are arranged to match the edge of a circular ear hole.

15. The ear hole cover according to claim 12, wherein the shaped perimeter is an oval such that the at least two tabs are arranged to match the edge of an oval ear hole.

16. The ear hole cover according to claim 12, wherein the shaped perimeter is a triangle such that the at least two tabs are arranged to match the edge of a triangular ear hole.

17. The ear hole cover according to claim 12, wherein the shaped perimeter is a polygon such that the at least two tabs are arranged to match the edge of a polygonal ear hole.

18. The ear hole cover according to claim 12, wherein the outer surface has a circular shape.

19. The ear hole cover according to claim 12, wherein the outer surface has an oval shape.

20. The ear hole cover according to claim 12, wherein the outer surface has a triangular shape.

21. An ear hole cover for headgear, comprising;

headgear adapted to be worn on a head of wearer comprising an ear hole that is configured to generally align with an ear of the wearer, the ear hole cover comprising;

a unitary body having an inner surface, a planar outer surface, and an even indicia surface across the outer surface for displaying an indicia;

a channel along a periphery of the body between the inner surface and the outer surface, the channel having opposite side walls that upwardly extend from a floor, the floor having a radius in the body that is less than an outer radius of the body, the body inserting into an ear hole in the headgear to position an edge of the ear hole in the channel of the body; and at least one hole extending through the body from the outer surface to the inner surface, the at least one hole configured for passing sound through the body to an ear of a wearer of the headgear.

* * * * *